United States Patent [19]

Montague, Jr.

[11] 4,065,834

[45] Jan. 3, 1978

[54] WATCHBAND

[76] Inventor: Archer A. Montague, Jr., Rte. 2, Box 589, Cary, N.C. 27511

[21] Appl. No.: 686,037

[22] Filed: May 13, 1976

[51] Int. Cl.[2] ..... A44B 17/00

[52] U.S. Cl. ..... 24/204

[58] Field of Search ..... 24/204

[56] References Cited

U.S. PATENT DOCUMENTS

| | | | |
|---|---|---|---|
| 1,599,011 | 9/1926 | Hohn | 24/204 |
| 2,035,674 | 3/1936 | Sipe | 24/204 |
| 2,499,898 | 3/1950 | Anderson | 24/204 |
| 3,653,099 | 4/1972 | Hoffman | 24/16 PB |
| 3,694,863 | 10/1972 | Wasserlein | 24/16 PB |
| 3,747,171 | 7/1973 | Montague | 24/265 WS |
| 3,947,927 | 4/1976 | Rosenthal | 24/204 |

FOREIGN PATENT DOCUMENTS

| | | | |
|---|---|---|---|
| 360,592 | 4/1962 | Switzerland | 24/204 |
| 1,103,471 | 2/1968 | United Kingdom | 24/204 |

*Primary Examiner*—Bernard A. Gelak
*Attorney, Agent, or Firm*—Mills & Coats

[57] ABSTRACT

In abstract, the preferred embodiment of this invention is a clasp for bands formed in at least two parts with the same being connected through two juxtaposed surfaces, one carrying a plurality of hook means and the other a plurality of loop means. The two portions are held in secured juxtaposed relationship to each other by means of a slidable loop with a lock in closed position. The securing loop is readily releasable by proper manipulation when separation of the two parts of the band is desired.

2 Claims, 7 Drawing Figures

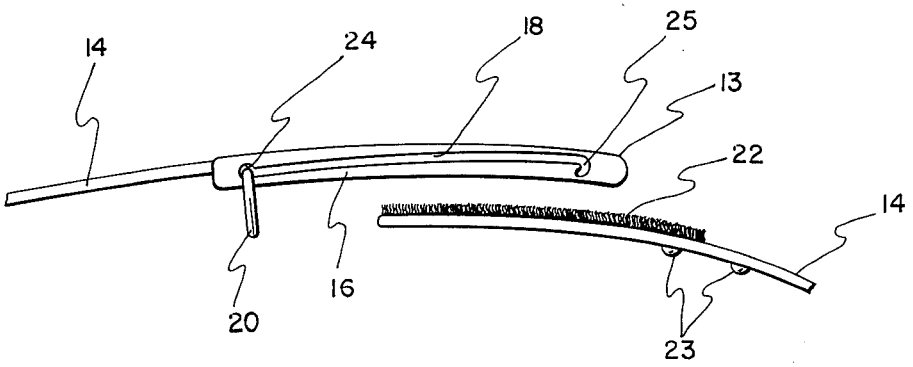
FIG. 5
FIG. 6
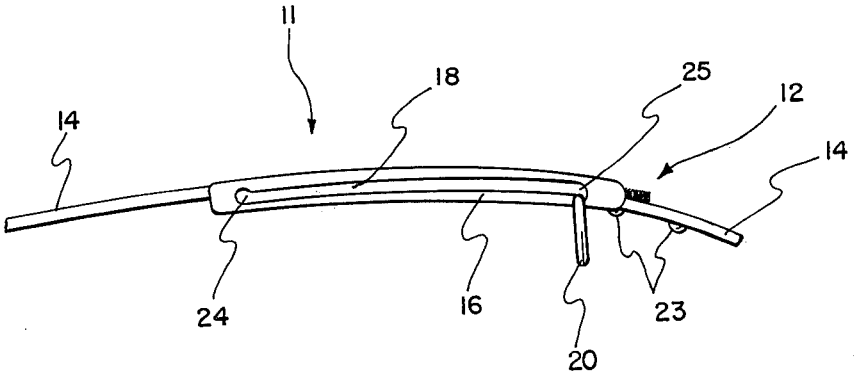
FIG. 7
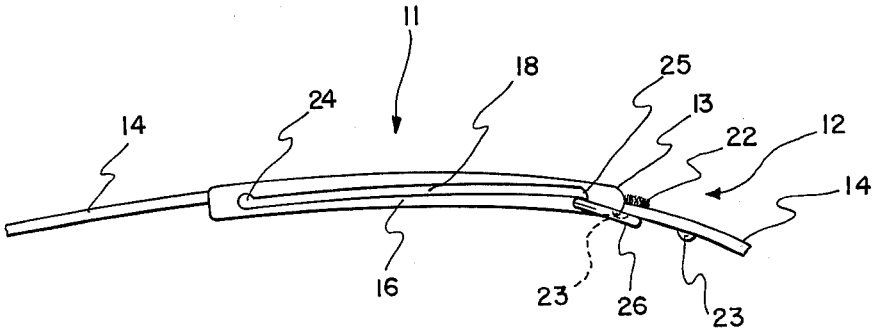

WATCHBAND

This invention relates to band and strap connecting means and particularly to band type securing devices.

In the past, various means have been devised to join two parts of a separable or extensible band or belt together. Particularly in the area of bands which secure jewelry to the wearer thereof there has been a need for a comfortable and yet secure but readily releasable fastening means. Buckle type bands have been used, but these are only adjustable at defined intervals thus more often than not causing the band to be too loose or too tight. Slide adjustable bands have been developed but have a tendency to slip and generally have been difficult to adjust. Various types of stretch bands have been considered but due to the natural tendency of the arm of the wearer to be smaller in cold weather and larger in warm weather, stretch bands are either too loose or too tight depending on the condition under which they were originally fitted. Also these bands do require individual fitting which, in a majority of instances, must be accomplished by a jeweler or someone similarly skilled which adds to the cost of the same.

A means for overcoming many of the above indicated problems was developed and is shown and described in U.S. Pat. No. 3,747,171 which was patented by the Inventor of the present invention. To even further improve on the locking and holding mechanism of the band securing means and yet provide for quick release by proper manipulation, the present invention has been developed. This invention includes a slidable U-shaped biasing member with a closed position releasable locking means for added security and yet simple operation.

In view of the above, it is an object of the present invention to provide an improved locking means for preventing accidental release of two releasably secured elongated members.

Another object of the present invention is to provide an easily releasable yet highly efficient releasable band locking means.

Another object of the present invention is to provide in a band type device having two separable members, the improvement comprising a slidable separation preventing means which is lockable in operative position.

Another object of the present invention is to provide a Velcro type securing means for band-like members having the safety features and styling of metal clasps or connectors.

Other objects and advantages of the present invention will become apparent and obvious from the study of the following description and the accompanying drawings which are merely illustrative of the present invention.

IN THE DRAWINGS:

FIG. 5 is a side elevational view of said portions prior to connection;

FIG. 6 is a side elevational view of said portions connected with the slide bail in its locking notch; and FIG. 7 is a side elevational view of the clasp of the present invention in full locked position.

Figure 1:
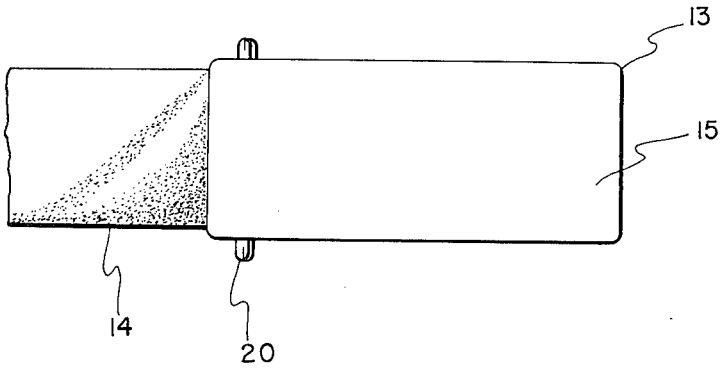
FIG. 1 is a top plan view of the buckle portion of the clasp of the present invention.
Figure 2:
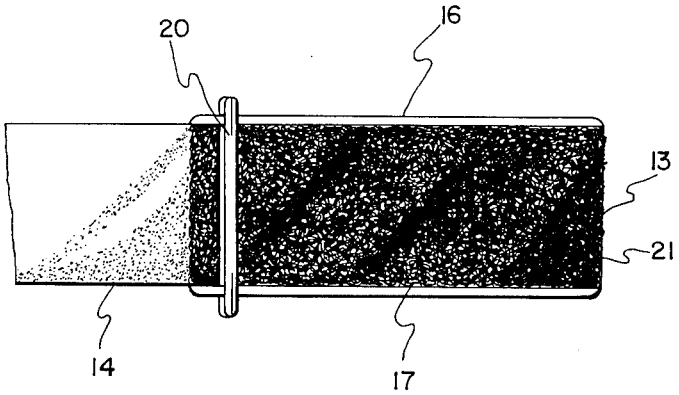
FIG. 2 is a bottom plan view of such buckle portion.
Figure 3:
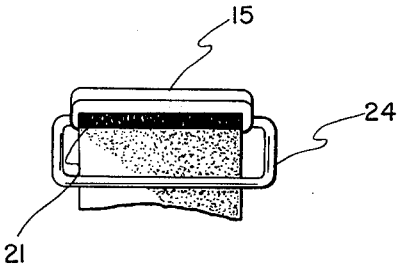
FIG. 3 is an end elevational view of the same.
Figure 4:
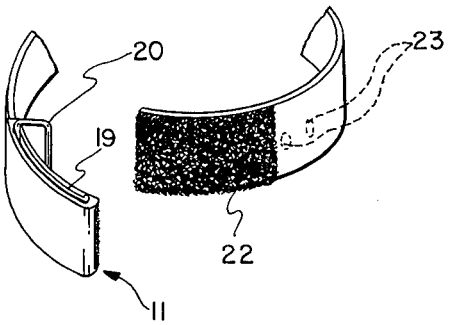
FIG. 4 is a perspective view of the buckle and tongue portions in released position.

With further reference to the drawings, the clasp of the present invention is composed of a buckle portion indicated generally at 11 and a tongue portion indicated generally at 12.

An open bottom housing or case 13 is provided which is fixedly secured to belt-like strap or band 14. The clasp or case housing 13 is composed of a top 15 and sides 16 and 17.

Elongated, somewhat J-shaped slots 18 and 19 are provided in sides 16 and 17. These slots are mirror images of each other and their purposes will hereinafter become obvious.

Either a somewhat C-shaped or flattened ring shaped slide bail 20 is provided which slidably engages slots 18 and 19 as seen clearly in the drawings.

A fibrous loop material 21 is provided in the open bottom portion of case 13. To the surface of tongue portion 12 adapted to be placed in juxtaposed relation to the fibrous material 21 is a surface covering or material 22 composed of a multiplicity of small resilient hook means. When materials 21 and 22 are placed juxtaposed to each other and pressure applied, the hooks 22 become entangled in the fibrous loops 21 to form a bond. This bond can be easily broken by peeling the layers apart but sliding the surfaces relatively to each other is extremely difficult. Securing products of this type are sold under the brand name of Velcro and since this material is well known to those skilled in the art, further discussion of the same is not deemed necessary.

Although the clasp of the present invention can be used for adjustably securing not only band-like members such as watchbands and pant belts but also such things as cargo tie-down straps and medical appliances, the present description will be limited to the securing of two strap-like means presuming that the same is in contactive relationship with the relatively resilient surface.

A plurality of longitudinally aligned buttons 23 are provided which are preferably semi-spherical in shape. These buttons can be attached to the tongue portion 12 in any convenient manner and are disposed on the side opposite material 22 as seen clearly in FIG. 5.

The enlarged opening 24 in the end of slot 18 allows bail 20 to freely swing when disposed in the general position shown in FIG. 5. This relative looseness of the bail in the slot allows the user of the clasp of the present invention to readily grasp the same for manipulation.

When the clasp is placed in the position that it is to be used, the hook material 22 can be positioned adjacent the fibrous loop material 21 in any one of an infinite number of longitudinal positions. Once the desired adjusted position is determined, materials 21 and 22 are placed in contactive, juxtaposed position to each other and pressed to engage the same. As mentioned above, longitudinal movement between the two surfaces is very difficult but a peeling action very readily releases the same.

Once the buckle and tongue are juxtaposed as hereinabove described, bail 20 is grasped and slid along slot 18 until it moves to the hook portion 25 of the J-shaped slots. Since the clasp of the present invention is primarily used with a relatively hard, resilient surface under the same, the bail is then moved up against the bottom of tongue portion 12 (as seen in FIG. 7) and the pressure of the back side thereof from the aforementioned surface will hold such bail in such position. It is obvious from FIG. 7 that the bail, when so disposed, will not slide toward opening 24 unless some pressure is applied to disconnect such bail from hook portion 25. Thus a locking effect is obtained. Buttons 23 further assure that no undesired slipping movement of the bail will occur.

To release the clasp as hereinabove described as being releasably secured, the slide bail 20 is grasped and disengaged from the hook portion 25 of slot 18. The bail is then slid along slot 18 to the enlarged opening area 24 thereof. The end of clasp 13 can then be grasped and the connection between materials 21 and 22 disengaged with a peeling action.

From the above, it can be seen that the present invention has the advantage of providing a relatively simple and yet extremely efficient clasp means which is readily connectable and disconnectable and yet, through use of a sliding safety bail, will not tend to become accidentally disengaged. Any peeling disengagement effect between the buckle and tongue portions will be checked by the safety bail which is slidingly secured to the buckle portion and yet passes under the tongue portion when in clasped position. The present invention also has the advantage of providing an anesthetically pleasing appearance and covers the functional Velcro type material which might otherwise detract from the clasp.

The terms "upper", "lower", and so forth have been used herein merely for convenience to describe the clasp and its parts as oriented in the drawings. It is to be understood, however that these terms are in no way limiting to the invention since the clasp may obviously be disposed in many different positions when it is used.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. A clasp means for releasably joining at least two elongated members comprising: a buckle portion on one of said members; a tongue portion on said second member; at least a portion of at least one surface on each of said buckle and tongue portions being covered with a contact adhering material; and a retaining means in the form of a generally C-shaped bail slidably mounted in an elongated, generally J-shaped slot on said buckle portion whereby said bail will at least partially encircle said tongue portion to prevent unintentional peeling separation of the adhered portions and said J-shaped slot will prevent accidental sliding of said bail when in the retaining position.

2. The clasp of claim 1 wherein the buckle portion includes a case-like housing incorporating said generally J-shaped slot therein.

* * * * *